US007067457B2

(12) United States Patent
Foster et al.

(10) Patent No.: US 7,067,457 B2
(45) Date of Patent: Jun. 27, 2006

(54) THERMAL DONOR FOR HIGH-SPEED PRINTING

(75) Inventors: David G. Foster, West Henrietta, NY (US); Maurice L. Gray, Rochester, NY (US); Teh-Ming Kung, Rochester, NY (US); William M. York, III, Rochester, NY (US); Brian T. Pope, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 145 days.

(21) Appl. No.: 10/667,065

(22) Filed: Sep. 17, 2003

(65) Prior Publication Data

US 2005/0059550 A1 Mar. 17, 2005

(51) Int. Cl.
*B41M 5/20* (2006.01)

(52) U.S. Cl. ..... 503/227; 428/32.64; 428/32.67

(58) Field of Classification Search ..... 8/471; 503/227; 428/32.64, 32.65, 32.66, 32.67, 428/32.68

See application file for complete search history.

(56) References Cited

U.S. PATENT DOCUMENTS

| | | | |
|---|---|---|---|
| 4,626,256 | A | 12/1986 | Kawasaki et al. |
| 4,643,917 | A | 2/1987 | Koshizuka et al. |
| 4,740,496 | A | 4/1988 | Vanier |
| 4,820,687 | A | 4/1989 | Kawasaki et al. |
| 4,822,674 | A | 4/1989 | Malhotra et al. |
| 4,839,338 | A | 6/1989 | Marbrow |
| 4,927,666 | A | 5/1990 | Kawasaki et al. |
| 4,968,659 | A | 11/1990 | Nishitani |
| 5,118,657 | A | 6/1992 | Kawakami et al. |
| 5,300,476 | A | 4/1994 | Kubodera et al. |
| 5,356,859 | A | 10/1994 | Lum et al. |
| 5,466,657 | A | 11/1995 | Egashira et al. |
| 5,674,804 | A | 10/1997 | Steen et al. |
| 5,763,358 | A | 6/1998 | Kaszczuk et al. |
| 5,801,118 | A | 9/1998 | Bowman et al. |

FOREIGN PATENT DOCUMENTS

| | | | |
|---|---|---|---|
| EP | 0390044 | B1 | 10/1993 |
| EP | 0718117 | A1 | 6/1996 |
| JP | 61262189 | | 5/1988 |
| JP | 63194983 | | 8/1988 |
| JP | 1990-196692 | | 8/1990 |
| JP | 02220887 | | 9/1990 |
| JP | 1991-75191 | | 3/1991 |
| JP | 1991-86588 | | 4/1991 |
| JP | 1991-178485 | | 8/1991 |
| JP | 1991-266692 | | 11/1991 |
| JP | 1992-112085 | | 4/1992 |
| JP | 60129295 | | 4/1992 |
| JP | 1992-163092 | | 6/1992 |
| JP | 1992-255394 | | 9/1992 |
| JP | 09202058 | | 8/1997 |
| JP | 09202059 | | 8/1997 |
| JP | 11105442 | | 4/1999 |
| WO | 01/87634 | A2 | 11/2001 |

*Primary Examiner*—Bruce H. Hess
(74) *Attorney, Agent, or Firm*—Kathleen Neuner Manne

(57) ABSTRACT

A dye-donor element including a dye-donor layer is described, wherein the dye-donor element includes a stick preventative agent. The dye-donor element is capable of printing an image on a receiver element at a line speed of 2 ms/line or less while maintaining a print density of at least two, and a print to fail value of at least four. A print assembly including the dye-donor element and a receiver element is also described, as well as a method of printing using the dye-donor element.

34 Claims, No Drawings

THERMAL DONOR FOR HIGH-SPEED PRINTING

CROSS REFERENCE TO RELATED APPLICATIONS

Reference is made to commonly assigned co-pending U.S. patent application Ser. No. 10/667,064 entitled "Thermal Print Assembly," to David G. Foster, et al., and commonly assigned co-pending U.S. patent application Ser. No. 10/664,684 entitled "Thermal Receiver," to Teh-Ming Kung, et al., both filed the same day as this application.

FIELD OF THE INVENTION

A dye-donor element suitable for use at high print speeds, a printer assembly including the dye-donor element, and a method of printing using the dye-donor element are described.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly which can be inserted between a thermal print head and a platen roller. A thermal print head can be used to apply heat from the back of the dye-donor sheet. The thermal print head can be heated up sequentially in response to the black, cyan, magenta, or yellow signals. The process can be repeated as needed to print all colors. A color hard copy corresponding to the original picture can be obtained. Further details of this process and an apparatus for carrying it out are contained in U.S. Pat. No. 4,621,271 to Brownstein.

A problem exists with many of the dye-donor elements and receiver elements used in thermal dye transfer systems. At the high temperatures used for thermal dye transfer, many polymers used in these elements can soften and adhere to each other, resulting in sticking and tearing of the elements upon separation. Areas of the dye-donor layer (other than the transferred dye) can adhere to the dye image-receiving layer, rendering the receiver element useless. This is especially a problem for high-speed printing, wherein the printing technique can result in higher temperatures in order to transfer suitable amounts of dye.

To reduce donor-receiver sticking, it is known to add release agents to the dye-donor element or the receiver element. Use of silicone waxes and oils as lubricating elements are known in the art. For example, JP 04-255394 is directed to a recording method for "high-speed" printing wherein the coloring material layer of the transfer body and/or the image-receiving layer of the image-receiving body contains a siloxane-containing moisture-curing resin. However, moisture-curing resins can crosslink within the image-receiving layer, reducing dye diffusion and dye stability; can reduce coating uniformity; and can require additional processing steps during manufacture.

JP 02-196692 is directed to a thermal transfer sheet capable of forming a high-density image at "high-speed," wherein a silicone resin is added to a dye layer in an amount of 1–20 parts by weight per 100 parts by weight of a dye-forming resin. U.S. Pat. No. 4,740,496 to Vanier discloses the use of various release agents in a dye layer of a dye-donor element, including various siloxanes. U.S. Pat. No. 5,356,859 to Lum et al. discloses the use of a dye image-receiving element including a polyoxyalkylene-modified dimethylsiloxane graft copolymer. The above disclosures, despite referring to "high-speed" printing, involve line speeds of greater than 4 ms. Such line speeds are not currently considered "high-speed."

U.S. Pat. No. 4,643,917 to Koshizuka describes silicone waxes for use in heat-sensitive transfer recording media, but does not achieve good quality images. JP 61-262189 discloses the use of polyoxyalkylene silicone copolymers as a release material for use in heat sensitive recording materials, particularly where the polyoxyalkylene is grafted into the polysiloxane backbone for use in very high power printers. Release agents such as those listed above can affect the quality of the image printed.

There is a need in the art for a means to reduce or eliminate donor-receiver sticking during high-speed or high voltage printing, and to produce high-density prints at high speeds.

SUMMARY OF THE INVENTION

A dye-donor element having a dye-donor layer, wherein the dye-donor element comprises a stick preventative agent, and wherein the dye-donor element, printed at a line speed of 2.0 ms/line or less, produces a defect-free image with a density of two or greater and a print to fail value of at least four is described.

A method of printing an image comprising image-wise transferring dye from the dye-donor element to a receiver element is described, wherein the image-wise transfer occurs at a line speed of 2.0 ms/line or less. According to various embodiments, the image can have a density of two or greater. According to various embodiments, the print to fail value can be at least four.

Use of the dye-donor element having the stick preventative agent can reduce or prevent sticking between the dye-donor element and the receiver element during printing at high-speed, for example, line speeds of 2.0 ms or less.

DETAILED DESCRIPTION OF THE INVENTION

A dye-donor element having a stick preventative agent, a printing assembly including the dye-donor element and a receiver element, and a method of printing using the dye-donor element are presented.

As used herein, "sticking" refers to adherence of a dye-donor element to a receiver element. Sticking can be detected by resultant defects in the dye-donor element or receiver element. For example, sticking can cause a removal of dye from the dye-donor element, appearing as a clear spot on the dye-donor element, or an over-abundance of dye on the receiver element. Sticking also can cause an uneven or spotty appearance on the dye-donor element. "Gross sticking" is when the dye-donor layer of the dye-donor element is pulled off of the support layer and sticks to the receiver element. This can appear as uneven and randomized spots across the dye-donor element and receiver element. "Microsticking" results in an undesirable image where a small area of the dye-donor element and receiver element stick together. Microsticking can be observed with a magnifying glass or microscope.

"Defect-free" or "defect-free image" as used herein refer to a printed image having no indication of donor-receiver sticking as set forth herein, and having no areas of dye-dropout in the image, wherein dye-dropout is defined as the absence of transfer of a dye-donor layer to the receiver element, or insufficient transfer of the dye-donor layer to the receiver element, on a pixel by pixel basis.

"Prints to fail" as used herein means the number of times an image can be printed with a print assembly as described herein at a temperature of about 8° C. with a print head having a voltage of about 16.7, before donor-receiver sticking. For example, a value of four prints to fail means no donor-receiver sticking occurs until at least the fifth print, and prints one through four are defect free. As used herein, a "print" refers to formation of an image on a receiver element using one dye patch on the dye-donor element.

The dye-donor element can include a dye-donor layer. The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be transferred to the receiver element, forming a colored image on the receiver element. The dye-donor layer can include a laminate area (patch) having no dye. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a three color image with a protective laminate layer on a receiver element.

Any dye transferable by heat can be used in the dye-donor layer of the dye-donor element. For example, sublimable dyes can be used, such as but not limited to anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5 GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures

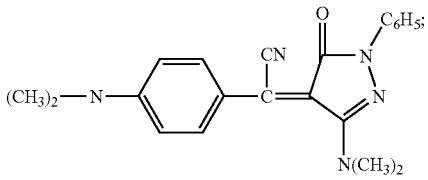

and (magneta)

-continued

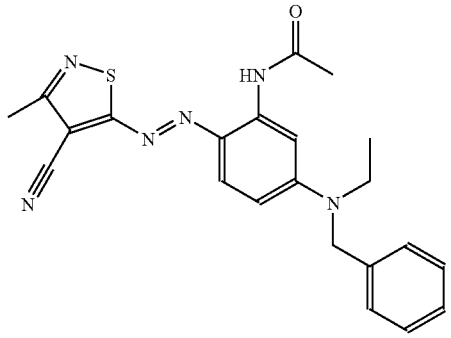

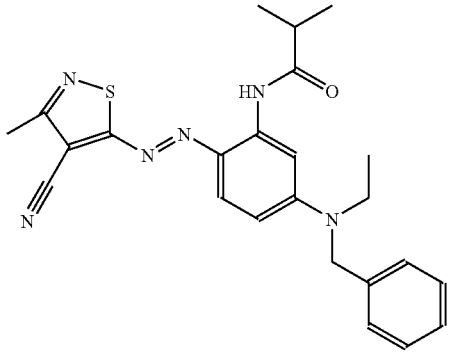

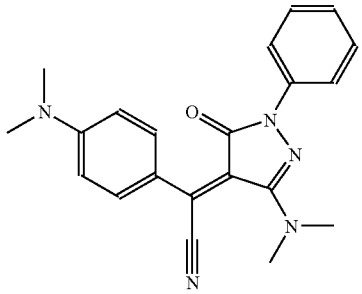

cyan dyes of the structures

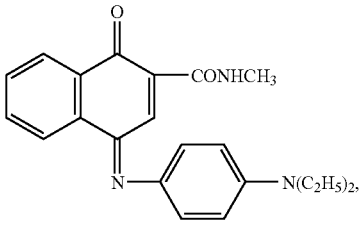

(cyan)

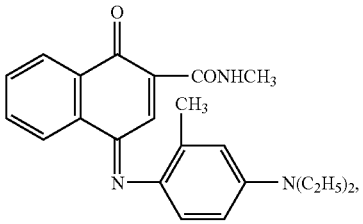

(cyan)

-continued

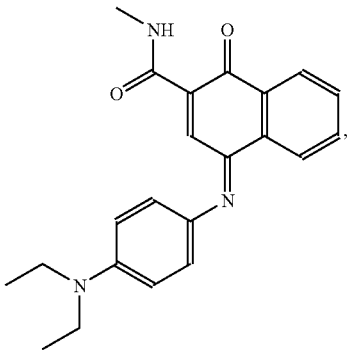

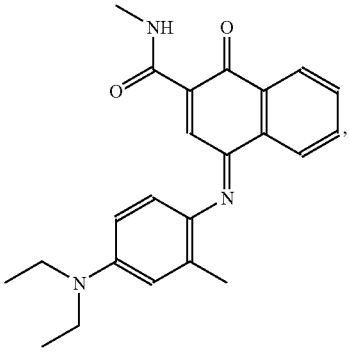

and

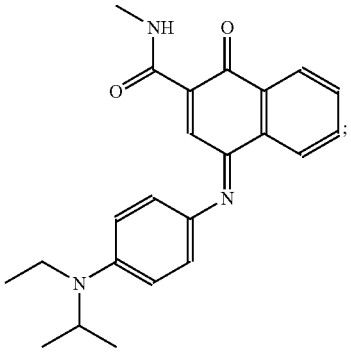

and yellow dyes of the structures

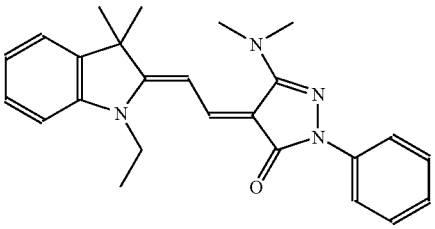

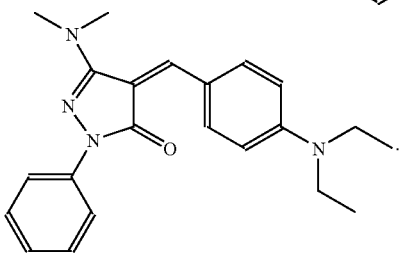

Other examples of dyes are set forth in U.S. Pat. No. 4,541,830, and are known to practitioners in the art. The dyes can be employed singly or in combination to obtain a monochrome dye-donor layer. The dyes can be used in an amount of from about 0.05 g/m$^2$ to about 1 g/m$^2$ of coverage. According to various embodiments, the dyes can be hydrophobic.

The dye-donor layer can have a dye to binder ratio for each color dye patch. For example, a yellow dye to binder ratio can be from about 0.3 to about 1.2, or from about 0.5 to about 1.0. A magenta dye to binder ratio can be from about 0.5 to about 1.5, or from about 0.8 to about 1.2. A cyan dye to binder ratio can be from about 1.0 to about 2.5, or from about 1.5 to about 2.0.

To form a dye-donor layer, one or more dyes can be dispersed in a polymeric binder, for example, a polycarbonate; a poly(styrene-co-acrylonitrile); a poly(sulfone); a poly (phenylene oxide); a cellulose derivative such as but not limited to cellulose acetate hydrogen phthalate, cellulose acetate, cellulose acetate propionate, cellulose acetate butyrate, or cellulose triacetate; or a combination thereof. The binder can be used in an amount of from about 0.05 g/m$^2$ to about 5 g/m$^2$.

The dye-donor layer of the dye-donor element can be formed or coated on a support. The dye-donor layer can be formed on the support by a printing technique such as but not limited to a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate); polyamides; polycarbonates; glassine paper; condenser paper; cellulose esters, for example, cellulose acetate; fluorine polymers, for example, polyvinylidene fluoride, and poly (tetrafluoroethylene-cohexafluoropropylene); polyethers, for example, polyoxymethylene; polyacetals; polyolefins, for example, polystyrene, polyethylene, polypropylene, and methylpentane polymers; polyimides, for example, polyimide-amides and polyether-imides; and combinations thereof. The support can have a thickness of from about 2 μm to about 30 μm, for example, from about 3 μm to about 7 μm.

According to various embodiments, a subbing layer, for example, an adhesive or tie layer, a dye-barrier layer, or a combination thereof, can be coated between the support and the dye-donor layer. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

The dye-donor element can also include a slip layer capable of preventing the print head from sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly (caprolactone), carbowax, polyethylene homopolymer, or poly(ethylene glycol). Suitable polymeric binders for the slip layer can include poly(vinyl alcohol-co-butyral), poly (vinyl alcohol-co-acetal), poly(styrene), poly(vinyl acetate), cellulose acetate butyrate, cellulose acetate, ethyl cellulose, and other binders as known to practitioners in the art. The amount of lubricating material used in the slip layer is dependent, at least in part, upon the type of lubricating material, but can be in the range of from about 0.001 to about 2 g/m$^2$, although less or more lubricating material can be used as needed. If a polymeric binder is used, the lubricating material can be present in a range of 0.1 to 50 weight %, preferably 0.5 to 40 weight %, of the polymeric binder.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer. For example, the stick preventative agent can be present in one or more patches of the dye-donor layer, in the support, in an adhesive layer, in the dye-barrier layer, in the slip layer, or in a combination thereof. According to various embodiments, the stick preventative agent can be in the slip layer and the dye-donor layer. According to various embodiments, the stick preventative agent is in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent.

The amount of stick preventative agent suitable for use in the dye-donor element depends on several factors, for example, the composition of the dye-donor element, the composition of the receiver element, the stick preventative agent used, and the print conditions, such as print speed and print head voltage. The stick preventative agent can be used in an amount of about 0.02 g/m$^2$ or less, about 0.01 g/m$^2$ or less, about 0.005 g/m$^2$ or less, from about 0.0001 g/m$^2$ to about 0.01 g/m$^2$, from about 0.0003 g/m$^2$ to about 0.0015 g/m$^2$, or from about 0.0005 g/m$^2$ to about 0.001 g/m$^2$. More or less stick preventative agent can be used as needed to prevent donor-receiver sticking. If too much stick preventative agent is used, a reduction in film strength, a decrease in dye transfer properties, a discoloration of dye, reduced staying or stability of dyes, or a combination thereof can occur. If too little stick preventative agent is used, no improvement in stick prevention can be seen.

The stick preventative agent can be a silicone- or siloxane-containing polymer. Suitable polymers can include graft co-polymers, block polymers, co-polymers, and polymer blends or mixtures. Suitable stick preventative agents can be used to prevent sticking of the dye-donor element and receiver element at high print speeds, for example, less than 4.0 ms/line, 2.0 ms/line or less, 1.5 ms/line or less, 1.0 ms/line or less, or 0.5 ms/line or less. Suitable stick preventative agents can also be used to prevent sticking at higher print head voltages, for example, voltages of 10 or more, or 20 or more. Suitable stick preventative agents can include those that provide a defect-free image on the receiver element, wherein the image has a density of at least two, while printing at high print speeds. Other suitable stick preventative agents can include those having a print to fail value of at least four while printing at high speeds.

The stick preventative agent can be selected from siloxane- or silicone-containing polymers such as, but not limited to, polydimethylsiloxanes, including polyalkyleneoxide modified polydimethylsiloxanes and acrylic functional polyester modified polydimethylsiloxanes; dimethylsiloxane-ethylene oxide block copolymers; polyalkyleneoxidimethylsiloxane copolymers; (polyethyleneoxide) siloxanes; cyclotetrasiloxanes, including octamethylcyclotetrasiloxane and phenylheptamethyl cyclotetrasiloxane; polymethyltetradecylsiloxanes; polymethyloctadecylsiloxanes; methyl-3,3,3-trifluoropropylsiloxanes; polypropyleneoxide siloxane copolymers; and combinations thereof. Further suitable stick preventative agents include, but are not limited to, epoxy functional silicones, and amine functional silicones. Other suitable stick preventative agents include polyoxyalkylene-modified dimethylsiloxane graft copolymers of the formula:

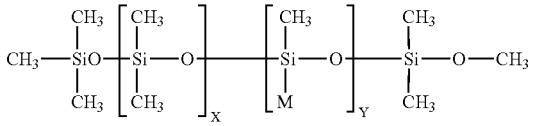

wherein

M is $-(C_3H_6-O)-(C_2H_4-O)_a-(C_3H_6-O)_b-R$,

R represents hydrogen or an alkyl group having from 1 to about 4 carbon atoms; X is 0 to 10; Y is 0.5 to 2; a is 0 to 100; b is 0 to 100; and a+b is greater than 45; a siloxane polymers of the formula:

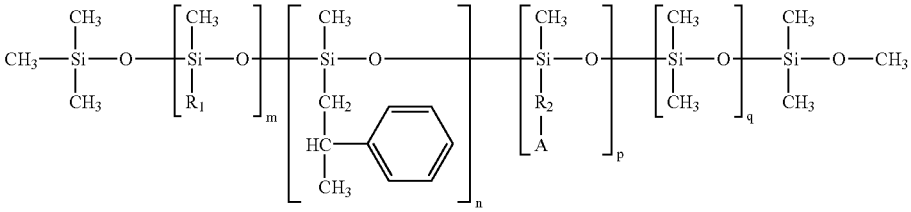

wherein $R_1$ is an alkyl chain of $C_9H_{19}$ or greater, $R_2$ is an alkyl chain of $C_3H_6$ or greater, A is NH—$R_3$, $NHNH_2$, or NHCO—$R_3$, $R_3$ is an alkyl chain of $C_2H_5$ or greater, m is from about 0 to 95 weight percent, n is from about 0 to about 70 weight percent, and p is from 0 to about 40 weight percent, q is from 0 to 95 weight percent, with the proviso that when m is 0, then n is 0, otherwise when m is greater than 0, n is from 0.1 to 70 weight percent, based on the total weight of the stick preventative agent. According to various embodiments, m can be from about 20 to 80 weight percent, n can be from about 1 to about 80 weight percent, more preferably from about 20 to about 80 weight percent, and p can be from 20 to about 40 weight percent when n and m are both 0, or any combination thereof. $R_1$, $R_2$, and $R_3$ can each independently be selected from straight or branched alkyl chains, except that when m and n are both 0, $R_3$ is an alkyl chain of $C_8H_{17}$ or greater.

Exemplary stick preventative agents include, for example, Vybar 103 from Baker-Petrolite of Sugar Land, Tex., USA; BYK-371 from BYK-Chemie USA of Wallingford, Conn., USA; Silwet L-7230 and Silwet L-7001 from Crompton Corporation of Long Reach, W.Va., USA; Dow Corning 175, 163, 57, 56, 25, 18, and 11, Dow 190, DC510, and Dow Corning HV-490 Emulsion, all from Dow Corning of Midland, Mich., USA; Zonyl-9223B and Zonyl-FSG from E.I. DuPont de Nemours and Company of Wilmington, Del., USA); DBE-224 from Gelest of Tullytown, Pa., USA; GP-4, GP-6, GP-RA-157, GP-148, GP-134, GP-478, GP-70-S, GP-32, GP-446, GP-4-E, GP-5, GP-501, GP-502, GP-50-A, GP-530, GP-7100, GP-7102, GP-7104-E, GP-71-SS, GP-7200, and GP-RA-156, all from Genesee Polymers Corporation of Flint, Mich., USA; Pecosil FSL-150 from Phoenix Chemical of Somerville, N.J., USA; PST 433 and PST-503 from Polysi Technologies, Inc., of Avon, Ohio, USA; S-379N and SST-3 from Shamrock Chemical of Dayton, N.J., USA; Tegopren 7008 from Tego Chemie Service USA of Hopewell, Va., USA; PS-130, PS-134, PS-181, PS-183, and PS-187 from United Chemical Technologies of Bristol, Pa., USA; and combinations thereof. Other suitable stick preventative agents will be apparent to practitioners in the art upon study and practice of the invention disclosed herein.

Optionally, release agents as known to practitioners in the art can also be added to the dye-donor element, for example, to the dye-donor layer, the slip layer, or both. Suitable release agents include those described in U.S. Pat. Nos. 4,740,496 and 5,763,358.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film, for example, a poly(ether sulfone), a polyimide, a cellulose ester such as cellulose acetate, a poly(vinyl alcohol-co-acetal), or a poly(ethylene terephthalate). The support can be a reflective layer, for example, baryta-coated paper, white polyester (polyester with white pigment incorporated therein), an ivory paper, a condenser paper, or a synthetic paper, for example, DuPont Tyvek® by E.I. DuPont de Nemours and Company. The support can be employed at any desired thickness, for example, from about 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used.

The dye image-receiving layer can be, for example, a polycarbonate, a polyurethane, a polyester, polyvinyl chloride, poly(styrene-co-acrylonitrile), poly(caprolactone), or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from about 1 $g/m^2$ to about 5 $g/m^2$.

Additional polymeric layers can be present between the support and the dye image-receiving layer. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as claimed in commonly assigned copending applications "Thermal Print Assembly," [Docket 86991] to David G. Foster, et al., and "Thermal Receiver," [Docket 86993] to Teh-Ming Kung, et al., both filed the same day as this application. According to various embodiments, the receiver element and dye-donor element can include the same stick preventative agent.

The dye-donor element and receiver element, when placed in superimposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise to the dye-donor element, causing the dyes in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, and a Rohm Thermal Head KE 2008-F3.

Use of the dye-donor element including a stick preventative agent as described herein allows high-speed printing of the print assembly with a print to fail amount of four or more, for example, at least six, or at least eight. Use of the dye-donor element including a stick preventative agent also allows high-speed printing with a resultant print density greater than or equal to two.

An improved dye-donor element including a stick preventative agent as described herein provides reduced donor-receiver sticking, a higher print density, and a higher number of prints to fail when used in a print assembly including the dye-donor element and a receiver element. The addition of the stick preventative agent to the dye-donor element does not appreciably affect Tg, melt viscosity, or coatability of any layer of the dye-donor element. Examples are herein provided to further illustrate the invention.

EXAMPLES

Example 1

An image containing 88 different color blocks separated by a black border was printed in cyan. The color blocks were randomized and comprised numerous shades and densities of color. Each block was a consistent shade and density of a specific color. Printing was done manually as described below.

After printing, the dye-donor element and receiver element were separated manually and examined for donor-receiver sticking. The examination was done by visual examination with a magnifying lens. Donor-receiver sticking was identified by the presence of defects, for example, a removal of dye from the dye-donor element, leaving the appearance of a clear spot on the dye-donor element; an uneven or spotty appearance on the dye-donor element in one or more of the color squares; the presence of unwanted dye transferred to the receiver element; and uneven and randomized spots across the dye-donor element and/or receiver element.

A dye-donor element was prepared by coating the following layers in the order recited on a first side of a 4.5 micron poly(ethylene terephthalate) support:

(1) a subbing layer of a titanium alkoxide (Tyzor TBT® from E.I DuPont de Nemours and Company) (0.12 g/m$^2$) from n-propyl acetate and n-butyl alcohol solvent mixture, and (2) a dye-donor layer containing cyan dye #1 (illustrated below) at 0.092 g/m$^2$, cyan dye #2 (illustrated below) at 0.084 g/m$^2$, and cyan dye #3 (illustrated below) at 0.21 g/m$^2$, cellulose acetate propionate binder at 0.22 g/m$^2$, polyester sebacate (Paraplex G-25) at 0.015 g/m$^2$, one of the inventive stick preventative agents (E-1–E-46) or comparative release agents (C-1–C-9) in n amount of 0.0009 g/m$^2$, and divinyl benzene beads at 0.008 g/m$^2$ coated from 75% toluene, 20% methanol and 5% cyclopentanone solvent mixture.

cyan dye #1

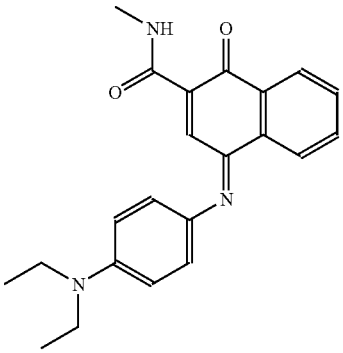

-continued cyan dye #2

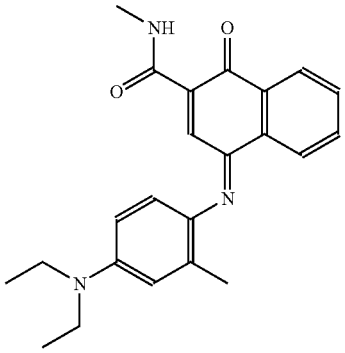

cyan dye #3

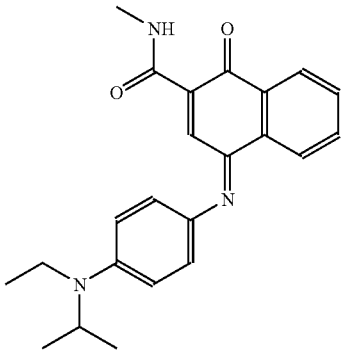

On a second side of the support, a slipping layer was prepared by coating the following layers in the order recited:

(1) a subbing layer of a titanium alkoxide (Tyzor TBT®) (0.12 g/m$^2$) from n-propyl acetate and n-butyl alcohol solvent mixture, and (2) a slipping layer containing an aminopropyl-dimethyl-terminated polydimethylsiloxane, PS513® (United Chemical Technologies) (0.01 g/m$^2$), a poly(vinyl acetal) binder (0.38 g/m$^2$) (Sekisui KS-1), p-toluenesulfonic acid (0.0003 g/m$^2$) and candellila wax (0.02 g/m$^2$) coated from a solvent mixture of diethylketone, methanol and distilled water (88.7/9.0/2.3).

A receiver element as shown below was prepared, having an overall thickness of about 220 μm and a thermal dye receiver layer thickness of about 3 μm.

| RECEIVER ELEMENT |
|---|
| 4–8 μm divinyl benzene beads and solvent coated cross-linked polyol dye receiving layer |
| Subbing layer |
| Microvoided composite film OPPalyte 350 K18 (ExxonMobil) |
| Pigmented polyethylene |
| Cellulose Paper |
| Polyethylene |
| Polyproplene film |

The dye side of the dye-donor element was placed in contact with the dye image-receiving layer of the receiver element of the same width to form a print assembly. The print assembly was fastened to a stepper motor driven pulling device. The print head was cooled with running water to 8° C. to simulate cold printing conditions that have been determined to be the most challenging for donor-receiver sticking. The imaging electronics were activated, causing the pulling device to draw the print assembly between the print head and a roller at a rate of about 3 mm/sec. The voltage supplied to the print was 16.7 volts. After each print, the dye-donor element and receiver element were separated manually and studied to determine if sticking occurred.

Results:

Table 1 indicates, for each donor-receiver combination, the stick preventative agent (E-1–E-46) or comparative release agent (C-1–C-9) added to the dye-donor layer, and the resultant prints to fail (PTF) value. Comparative examples (C-1–C-9) are release agents known to practitioners in the art, and are described, for example, in U.S. Pat. No. 4,740,496 to Vanier.

TABLE 1

| Ex. # | Compound | Description | PTF |
|---|---|---|---|
| E1 | Silwet L-7230 | polyalkyleneoxidemethylsiloxane copolymer | 12 |
| E2 | Dow Corning 175 | silicone emulsion | 12 |
| E3 | Dow Corning 18 | silicone | 12 |
| E4 | GP-4 | amine functional silicone | 10 |
| E5 | GP-6 | amine functional silicone | 10 |
| E6 | Dow Corning 57 | dimethyl, methyl(polyethyleneoxide) siloxane | 9 |
| E7 | Dow 190 | octamethylcyclotetrasiloxane | 8 |
| E8 | Dow Corning 56 | alpha-methyl styrene | 8 |
| E9 | GP-RA-157 | amine functional silicone | 8 |
| E10 | Silwet L-7001 | polyalkyleneoxide modified polydimethylsiloxane | 8 |
| E11 | BYK-371 | acrylic functional polyester modified dimethylpolysiloxane | 7 |
| E12 | DBE-224 | dimethylsiloxane-ethylene oxide block copolymer | 7 |
| E13 | GP-134 | amine functional silicone | 7 |
| E14 | Pecosil FSL-150 | polydimethylsiloxane | 7 |
| E15 | Dow Corning 163 | methylated silica | 6 |
| E16 | GP-478 | Silicone Fluid | 6 |
| E17 | GP-70-S | Paintable Silicone Fluid | 6 |
| E18 | PST-433 | phenylheptamethyl cyclotetrasiloxane | 6 |
| E19 | PST-503 | dimethyl polysiloxane | 6 |
| E20 | Zonyl-9223B | di-isoheptyl-phthalate and fluorinated acrylic copolymer | 6 |
| E21 | Dow Corning 11 | dimethyl(methyl polyethylene oxide, polypropylene oxide siloxane copolymer | 5 |
| E22 | Dow Corning 25 | hexamethoxymethyl melamine | 5 |
| E23 | Dow Corning HV-490 Emulsion | polydimethylsiloxane | 5 |
| E24 | GP-32 | epoxy functional silicone | 5 |
| E25 | GP-446 | polydimethylsiloxane | 5 |
| E26 | GP-4-E | polyamino-functional silicone | 5 |
| E27 | GP-5 | emulsifiable paintable silicone fluid | 5 |
| E28 | GP-501 | silicone fluid | 5 |
| E29 | GP-502 | epoxy functional silicone | 5 |
| E30 | GP-50-A | amine functional silicone | 5 |
| E31 | GP-530 | modified silicone copolymer | 5 |
| E32 | GP-7100 | amine functional silicone | 5 |
| E33 | GP-7104-E | amine functional silicone | 5 |
| E34 | GP-71-S | silicone fluid | 5 |
| E35 | GP-7200 | silicone fluid | 5 |
| E36 | GP-RA-156 | amine functional silicone | 5 |
| E37 | PS-130 | polymethyloctadecylsiloxane | 5 |
| E38 | PS-134 | polymethyltetradecylsiloxane | 5 |
| E39 | P5-181 | polymethyl-3,3,3-trifluoropropylsiloxane | 5 |
| E40 | PS-183 | polymethyl-3,3,3-trifluoropropylsiloxane | 5 |
| E41 | PS-187 | polydimethyl, methyl-3,3,3-trifluoropropylsiloxane copolymer | 5 |
| E42 | S-379N | Hydrocarbon wax | 5 |
| E43 | SST-3 | polytetrafluoroethylene Polymer | 5 |
| E44 | Tegopren 7008 | siloxane copolymer | 5 |
| E45 | Vybar 103 | polyalphaolefin | 5 |
| E46 | Zonyl-FSG | fluorinated methacrylic copolymer | 5 |
| C1 | BYK-320 | copolymer of polyalkyleneoxide and methylalkylsiloxane | 3 |
| C2 | BYK-301 | copolymer of polyalkyleneoxide and methylalkylsiloxane | 3 |
| C3 | Canuba Wax | canuba wax | 3 |
| C4 | FC-430 | perfluoronated alkyl-sulfonamidoalkyl ester of a polyethylene-propylene glycol | 3 |

TABLE 1-continued

| Ex. # | Compound | Description | PTF |
|---|---|---|---|
| C5 | FC-431 | $C_8F_{17}SO_2N(C_2H_5)-CH_2-C(=O)-O-(CH_2-CH_2-O)_{40}-H$ | 3 |
| C6 | Kemamide E | $C_{21}H_{41}CONH_2$ | 3 |
| C7 | Kemamide E 221 | $C_8H_{17}CH{=}CHC_{11}H_{22}CONHC_{12}H_{24}CH{=}CHC_8H_{17}$ | 3 |
| C8 | S 395 N 5 | polyethylene wax | 3 |
| C9 | Stearic Acid | stearic acid | 3 |

Table 1 shows that improved prints to fail values are achieved with stick preventative agents of the claimed invention as compared to known release agents.

Example 2

Two dye-donor elements were prepared as in Example 1, with either 1) no slip preventative agent or release agent, or 2) Silwet L-7230 at 0.001 g/m$^2$. The receiver element was prepared as in Example 1.

An image containing 160 different color blocks separated by a black border was printed in cyan. The color blocks were randomized and comprised numerous shades and densities of color. Each block was a consistent shade and density of a specific color. Printing was done as described in Example 1.

Two different printers were used to print a print assembly including either dye-donor element, and the receiver. The printers are described in Table 2 below.

TABLE 20

| | PRINTER #1 | PRINTER #2 |
|---|---|---|
| Dots per Inch | 300 | 300 |
| Watts/Dot | 0.11 | 0.135 |
| Typical THV | 23 V | 25 V |
| Line Times | 4 millisecond | 1 millisecond |

Each dye-donor material was printed on the receiver in each printer. The printing process was repeated up to ten times for each donor-receiver combination in each printer. After printing, the dye-donor element and receiver element were separated manually and examined for donor-receiver sticking. The examination was done by visual examination with a magnifying lens. Donor-receiver sticking was identified by the presence of defects, for example, a removal of dye from the dye-donor element, leaving the appearance of a clear spot on the dye-donor element; an uneven or spotty appearance on the dye-donor element in one or more of the color squares; the presence of unwanted dye transferred to the receiver element; and uneven and randomized spots across the dye-donor element and/or receiver element. The results are shown in Table 3. For each donor-receiver combination in a respective printer, the results were the same.

TABLE 3

| Printer | Donor without Silwet L-7230 | Donor with Silwet L-7230 |
|---|---|---|
| #1 | No Sticking | No Sticking |
| #2 | Gross Sticking | No Sticking |

The data in the above table illustrates that no sticking was observed when printing either dye-donor element with a printer with a 4 millisecond line time. When printing with a 1 millisecond line time, acceptable prints without sticking were observed only when a sticking prevention agent, in this example, Silwet L-7230, was incorporated in the dye-donor patch.

The invention has been described in detail with particular reference to certain preferred embodiments thereof, but it will be understood that variations and modifications can be effected within the spirit and scope of the invention.

What is claimed is:

1. A dye-donor element having a dye-donor layer, wherein the dye-donor element comprises a stick preventative agent of alpha-methyl styrene, cyclotetrasiloxane, polyalkyleneoxide methylsiloxane, polyalkyleneoxide modified polydimethylsiloxane or a combination thereof, and wherein the dye-donor element, printed at a line speed of 2.0 ms/line or less, produces a defect-free image with a density of two or greater.

2. The dye-donor element of claim 1, wherein the stick preventative agent is in the dye-donor layer.

3. The dye-donor element of claim 1, further comprising at least one of a support, a dye-barrier layer, a slip layer, or an adhesive layer.

4. The dye-donor element of claim 3, wherein the support is ≦7 μm.

5. The dye-donor element of claim 3, wherein the stick preventative agent is in the dye-donor layer and the slip layer.

6. The dye-donor element of claim 3, wherein the stick preventative agent is present in one or more of the support, dye-barrier layer, or adhesive layer.

7. The dye-donor element of claim 1, wherein the print speed is 1.5 ms/line or less.

8. The dye-donor element of claim 1, wherein the print speed is 1.0 ms/line or less.

9. The dye-donor element of claim 1, further having a dye to binder ratio of at least 0.6.

10. The dye-donor element of claim 1, wherein the stick preventative agent is added in an amount of from about 0.001 g/m$^2$ to about 0.01 g/m$^2$.

11. The dye-donor element of claim 1, wherein the stick preventative agent is added in an amount of from about 0.0003 g/m$^2$ to about 0.0015 g/m$^2$.

12. The dye-donor element of claim 1, wherein the stick preventative agent is a polyalkyleneoxide modified polydimethylsiloxane, a polyalkyleneoxidimethylsiloxane copolymer; an octamethylcyclotetrasiloxane; a phenylheptamethyl cyclotetrasiloxane; an alpha-methyl styrene; or a combination thereof.

13. The dye-donor element of claim 1, wherein the stick preventative agent is a polyoxyalkylene-modifled dimethylsiloxane graft copolymer of the formula:

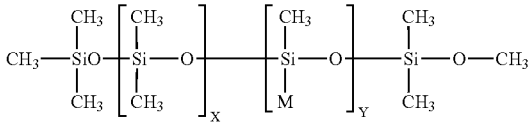

wherein

M is $-(C_3H_6-O)-(C_2H_4-O)_a-(C_3H_6-O)_b-R$,

R represents hydrogen or an alkyl group having from 1 to about 4 carbon atoms; X is 0 to 10; Y is 0.5 to 2; a is 0 to 100; b is 0 to 100; and a+b is greater than 45.

14. The dye-donor element of claim 1, wherein the stick preventative agent is a siloxane polymer of the formula:

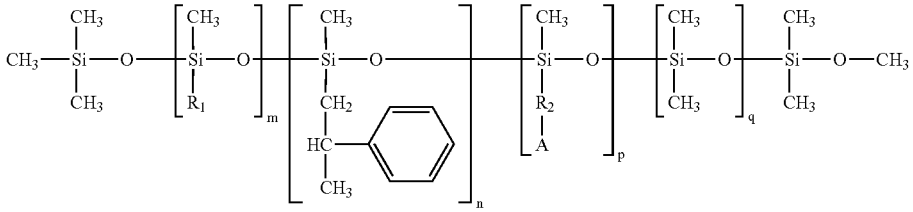

wherein $R_1$ is an alkyl chain of $C_9H_{19}$ or greater, $R_2$ is an alkyl chain of $C_3H_6$ or greater, A is NH—$R_3$, $NHNH_2$, or NHCO—$R_3$, $R_3$ is an alkyl chain of $C_2H_5$ or greater, m is from about 0 to 95 weight percent, n is from about 0 to about 70 weight percent, and p is from 0 to about 40 weight percent, q is from 0 to 95 weight percent, with the proviso that when m is 0, then n is 0, and $R_3$ is an alkyl chain of $C_8H_{17}$ or greater, otherwise when m is greater than 0, n is from 0.1 to 70 weight percent, based on the total weight of the stick preventative agent.

15. A dye-donor element having a dye-donor layer, wherein the dye-donor element comprises a stick preventative agent of alpha-methyl styrene, cyclotetrasiloxane, polvalkyleneoxide methylsiloxane, polyalkyleneoxide modified polydimethylsiloxane or a combination thereof, and wherein the dye-donor element, printed at a line speed of 2.0 ms/line or less, produces a defect-free image with a print to fail value of at least four.

16. The dye-donor element of claim 15, wherein the print to fail value is at least six.

17. The dye-donor element of claim 15, wherein the image has a density of two or greater.

18. The dye-donor element of claim 15, wherein the stick preventative agent is in the dye-donor layer.

19. The dye-donor element of claim 15, further comprising at least one of a support, dye-barrier layer, a slip layer, or an adhesive layer.

20. The dye-donor element of claim 19, wherein the support is ≦7 μm.

21. The dye-donor element of claim 19, wherein the stick preventative agent is present in the dye-donor layer and the slip layer.

22. The dye-donor element of claim 19, wherein the stick preventative agent is present in one or more of the support, dye-barrier layer, or adhesive layer.

23. The dye-donor element of claim 15, wherein the print speed is 1.5 ms/line or less.

24. The dye-donor element of claim 15, wherein the print speed is 1.0 ms/line or less.

25. The dye-donor element of claim 15, further having a dye to binder ratio of at least 0.6.

26. The dye-donor element of claim 15, wherein the stick preventative agent is added in an amount of from about 0.00 1 $g/m^2$ to about 0.01 $g/m^2$.

27. The dye-donor element of claim 15, wherein the stick preventative agent is added in an amount of from about 0.0003 $g/m^2$ to about 0.0015 $g/m^2$.

28. The dye-donor element of claim 15, wherein the stick preventative agent is a polyalkyleneoxide modified polydimethylsiloxane; a polyalkyleneoxidimethylsiloxane copolymer; an octamethylcyclotetrasiloxane; a phenylheptamethyl cyclotetrasiloxane; an alpha-methyl styrene; or a combination thereof.

29. The dye-donor element of claim 15, wherein the stick preventative agent is a polyoxyalkylene-modified dimethylsiloxane graft copolymer of the formula:

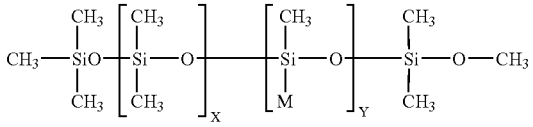

wherein

M is $-(C_3H_6-O)-(C_2H_4-O)_a-(C_3H_6-O)_b-R$,

R represents hydrogen or an alkyl group having from 1 to about 4 carbon atoms; X is 0to 10; Y is 0.5 to 2; a is 0 to 100; b is 0 to 100; and a+b is greater than 45.

30. The dye-donor element of claim 15, wherein the stick preventative agent is a siloxane polymer of the formula:

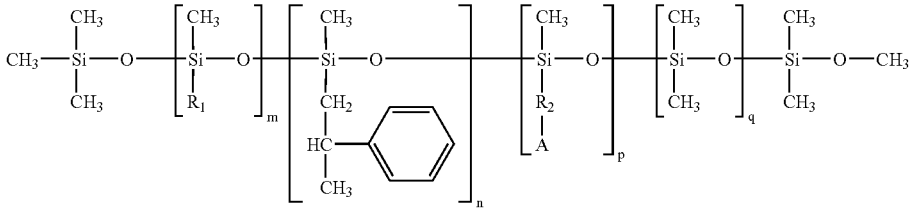

wherein $R_1$ is an alkyl chain of $C_9H_{19}$ or greater, $R_2$ is an alkyl chain of $C_3H_6$ or greater, A is NH—$R_3$, $NHNH_2$, or NHCO—$R_3$, $R_3$ is an alkyl chain of $C_2H_5$ or greater, m is from about 0 to 95 weight percent, n is from about 0 to about 70 weight percent, and p is from 0 to about 40 weight percent, q is from 0 to 95 weight percent, with the proviso that when m is 0, then n is 0, and $R_3$ is an alkyl chain of $C_8H_{17}$ or greater, otherwise when m is greater than 0, n is from 0.1 to 70 weight percent, based on the total weight of the stick preventative agent.

31. A printing assembly comprising the dye-donor element of claim 1 and a receiver element.

32. A printing assembly comprising the dye-donor element of claim 15 and a receiver element.

33. A method of printing an image comprising image-wise transferring dye from a dye-donor element to a receiver element, wherein the image-wise transfer occurs at a line speed of 2.0 ms/line or less, the image has a density of two or greater, and the dye-donor element comprises a stick preventative agent of alpha-methyl styrene, cyclotetrasiloxane, polyalkyleneoxide methylsiloxane, polyalkyleneoxide modified polydimethylsiloxane or a combination thereof.

34. A method of printing an image comprising image-wise transferring dye from a dye-donor element to a receiver element, wherein the image-wise transfer occurs at a line speed of 2.0 ms/line or less, the dye-donor element has a print to fail value of at least four, and the dye-donor element comprises a stick preventative agent of alpha-methyl styrene, cyclotetrasiloxane, polyalkyleneoxide methylsiloxane, polyalkyleneoxide modified polydimethylsiloxane or a combination thereof.

* * * * *